US005706973A

United States Patent [19]

Robbins, III et al.

[11] Patent Number: 5,706,973

[45] Date of Patent: Jan. 13, 1998

[54] DRINKING CUP AND COVER WITH FLOW CONTROL ELEMENTS

[75] Inventors: Edward S. Robbins, III, Muscle Shoals, Ala.; Gregory S. Burcham, Tucson, Ariz.

[73] Assignee: E. S. Robbins Corporation, Muscle Shoals, Ala.

[21] Appl. No.: 791,380

[22] Filed: Jan. 30, 1997

[51] Int. Cl.[6] ..... A47G 19/22

[52] U.S. Cl. ..... 220/714; 215/11.5; 222/482; 137/588

[58] Field of Search ..... 220/714, 367.1; 215/11.4, 11.5, 389, DIG. 7; 137/587, 588; 222/482

[56] References Cited

U.S. PATENT DOCUMENTS

| | | | |
|---|---|---|---|
| 2,608,841 | 9/1952 | Rice | 215/11.5 X |
| 4,836,404 | 6/1989 | Coy | 220/714 |
| 4,946,062 | 8/1990 | Coy | 220/714 |
| 5,477,980 | 12/1995 | Chaffin | 220/714 X |
| 5,542,670 | 8/1996 | Morano | 137/588 X |

*Primary Examiner*—Steven M. Pollard
*Attorney, Agent, or Firm*—Locke Reynolds

[57] ABSTRACT

A drinking cup having a body portion and a removably attached cover including an offset drinking spout and an offset vent aperture. The drinking spout and the vent aperture are each surrounded by wall members which depend generally away from an interior surface of the cover. An air inlet flow control valve is coupled to the wall member surrounding the vent aperture while a liquid outlet flow control valve is coupled to the wall member surrounding the spout. Each flow control valve includes a domed elastomeric member containing a slit allowing for passage of a selected fluid therethrough. The domed portions are each surrounded by a generally circular isolating channel, and outside of each isolating channel is a perimetral portion for connecting the flow control valve to the depending wall portion of the cover. Fluids passing through the slits achieve substantially only a one-way passage as the domed curvature substantially prevents any backflow. Vacuum must be applied on the convex side of the domed portion for sufficient elastomeric displacement to allow a fluid to pass through the slit. In the absence of such a vacuum, the sides of the slit are maintained in contiguous contact thereby preventing any transfer of liquid or air across the respective flow control valve. Coupling means are provided for coupling the flow control valves together, and may include handle portions integrally attached to the perimetral portion and including joining means for joining the handle portions together.

36 Claims, 5 Drawing Sheets

DRINKING CUP AND COVER WITH FLOW CONTROL ELEMENTS

BACKGROUND OF THE INVENTION

1. Field of the Invention

The present invention relates to devices employed to prepare young children to transfer from drinking liquids from a nippled bottle to drinking liquids from an open topped cup or similar container. Similar devices are also employed to assist certain physically handicapped individuals and typically consist of a cup having a cover including special features intended to facilitate the ingestion of liquid from the cup while minimizing the amount of liquid spilled from the cup. The cover for the drinking cup typically includes a spout allowing withdrawal of liquid from the container and one or more vent apertures allowing air into the covered container as liquid is withdrawn.

2. Description of the Prior Art

In an effort to reduce further the amount of liquid spilled from an upset drinking cup, some covers have incorporated valves to control the amount of air admitted into the cup during the drinking process and valves to control the amount of liquid released from the cup. These valves, when operating in the intended manner, substantially eliminate accidental spills from the cup. Examples of such cups are to be found in Morano, U.S. Pat. No. 5,542,670; Belanger, U.S. Pat. No. 5,079,013; Coy, U.S. Pat. No. 4,946,062; Paz, U.S. Pat. No. 3,739,938; and, Rice, U.S. Pat. No. 2,608,841.

Some of the prior art devices require manipulation of elements of the cup in order to achieve optimal controlled venting and sealing of the container. It has been recognized that young children and others which would benefit from employing such training cups are not capable of reliably operating such manual valving devices. As a result, vent control has increasingly employed structures which would automatically achieve the desired effects. There has also been a recognition that many of the prior art devices involved parts which were difficult to reliably manufacture, required significant assembly and were difficult to clean. Thus, designs have been sought which minimize the number of parts while reliably achieving all of the desired valving functions to arrive at a truly dripless container while employing a minimum of materials.

SUMMARY OF THE INVENTION

Accordingly, a drinking cup of the present invention employs a body portion to which is removably attached a cover having an outer perimeter which is generally symmetric about a centrally located axis. The cover includes a drinking spout offset to one side of said axis and a vent aperture offset to the opposite side of said axis. The drinking spout and the vent aperture are each surrounded by wall members which depend generally away from an interior surface of the cover. An air inlet flow control valve is coupled to the wall member surrounding the vent aperture while a liquid outlet flow control valve is coupled to the wall member surrounding the liquid outlet or spout.

Each of the flow control valves comprises a domed elastomeric member containing a slit allowing for passage of a selected fluid through the domed portion. The domed portions of each of the flow control valves is surrounded by a circular isolating channel. Outside of each circular isolating channels is a perimetral portion for connecting the flow control valve to the depending wall portion of the cover. The perimetral portion connecting the flow control valve to the depending wall portion can take the form of either an outwardly facing surface adapted to engage the interior of the depending wall portion or an inwardly facing surface adapted to engage the exterior of the depending wall portion.

The domed portion of each of the valves is preferably formed from a substantially uniform thickness of elastomeric material such as 6070 silicone rubber having a hardness of approximately 70 Shore A. The radius defining the domed portion of each flow control valve is greater than the radius of the circular isolating channel surrounding each domed portion so that the domed portion constitutes less than a hemisphere. The slit in the domed portion occupies between about 25 to about 45% of the diameter of the domed portion and is centered on the most protuberant part of the domed portion. In this manner, the fluid passing through the slit can achieve substantially only a one-way passage since the domed curvature substantially prevents any backflow of fluid through the flow control valve. Additionally, with the slit occupying less than the full diameter of the domed portion, some minimal vacuum must be applied on the convex side of the domed portion in order to achieve sufficient elastomeric displacement to allow the intended fluid, whether liquid or air, to pass through the slit. In the absence of such a vacuum, the sides of the slit are maintained in contiguous contact thereby preventing any transfer of liquid or air across the respective flow control valve.

In a preferred embodiment, coupling means are provided for coupling the two flow control valves together. The coupling means can comprise a handle portion integrally attached to the perimetral portion of the flow control valve and including joining means for joining the handle portion of one of the flow control valves to the handle portion of the other of the flow control valves. The coupling means can also have the form of a continuous bridge between the two flow control valves. Preferably, the joining means separably co-engages the handle portions so that either one or both of the flow control valves can be removed from the cover for cleaning or in situations where less restriction of the flow of one or both fluids through the cover is desired.

In a particularly preferred embodiment, the coupling means comprises a diaphragm having an outer edge positioned between an upper edge of the body portion and a lower inner edge of the cover so as to provide a seal between the body portion and cover. The diaphragm also isolates the interior surface of the cover from the contents of the drinking cup thereby reducing the possibility of residual food contamination from retained material in interior corners of the cover.

One feature of a drinking cup in accordance with the present invention is a body portion which includes a narrow waist integrally formed with a broadened base which enhances the overall ability of the cup to resist tipping and spilling. The narrow waist portion also has the advantage of allowing the small hands of a young child to more easily manipulate the container as a whole.

Another feature of the present invention is the control of the exit of liquid from the drinking cup using flow control valves which are formed from low cost, safe materials which are easily cleaned and secured to the interior of the drinking cup in such a manner as to significantly diminish the likelihood of a valve defeating manipulation by a child while employing the drinking cup.

These and other features and advantages will become apparent to those skilled in the art upon consideration of the following description of the preferred embodiments exemplifying the best mode of the invention. The description refers to the accompanying figures illustrating the preferred embodiments of the invention.

DESCRIPTION OF THE PREFERRED EMBODIMENTS

Figure 1:
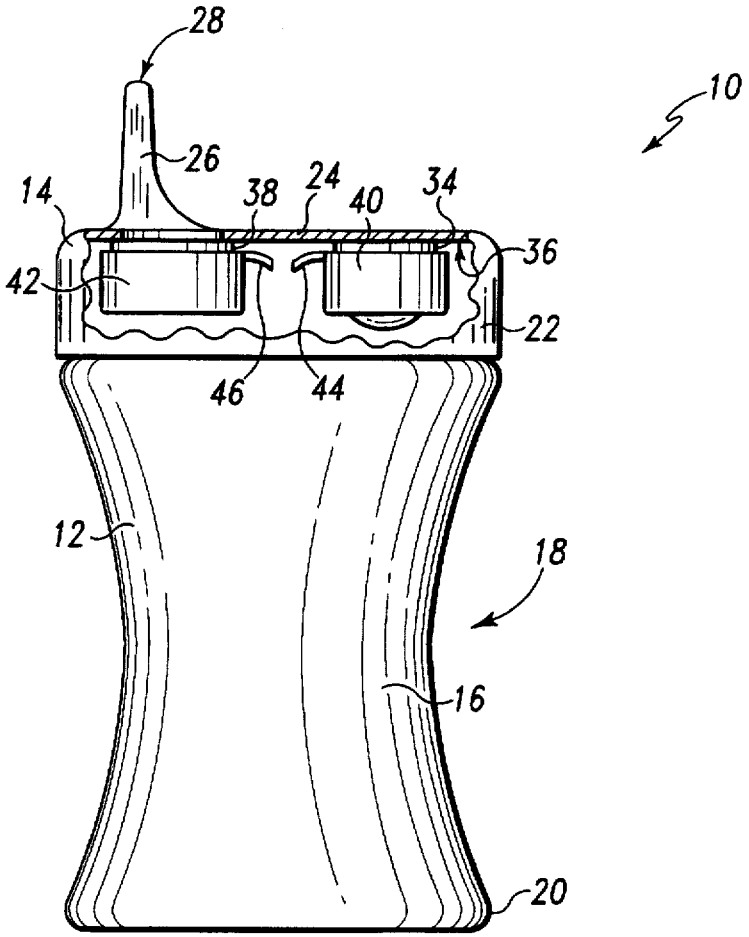
FIG. 1 is a side elevation view of a drinking cup in accordance with the present invention partially broken away to reveal the location of the flow control valves coupled to the interior surface of the cover.

A drinking cup 10 in accordance with the present invention is shown in FIG. 1 to comprise a body portion 12 and a cover 14 removably attached to the body portion 12. The body portion 12 is preferably shaped to include a concave sidewall 16 defining a narrow waist 18 supported by a broader base 20. An upper margin, not shown, of body portion 12 projects inside a skirt portion 22 of cover 14 which includes threads or other features well known in the art permitting a releasable locking engagement between the body portion 12 and the cover 14.

Figure 2:
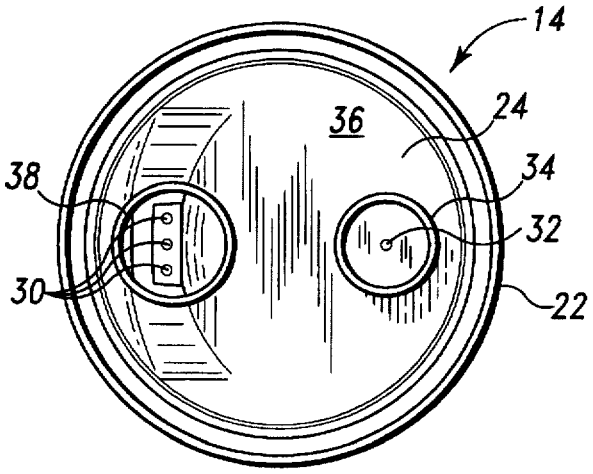
FIG. 2 is a bottom plan view of the cover shown in FIG. 1 with the flow control valves removed to reveal the interior structure of the vent aperture and spout.

The cover 14 includes a top wall 24 which includes an upwardly projecting spout 26. Distal end 28 of spout 26 includes a plurality of holes 30 which can be seen in FIG. 2. The spout 26 is shown to be offset to the left side of the cover 14 as shown in FIGS. 1 and 2. A vent aperture 32, offset to the right side of cover 14, allows air to enter the covered drinking cup as liquid exits the covered drinking cup through holes 30. A first wall member 34 depends generally away from an interior surface 36 of top wall 24 surrounding the vent aperture 32. A second wall member 38 surrounds the outlet holes 30 as shown in FIGS. 1 and 2.

Air inlet flow control valve 40 is secured to first wall member while liquid outlet flow control valve 42 is secured to second wall member 38. As shown in FIG. 1, the flow control valves 40 and 42 are independent of each other and include first and second handle portions 44 and 46, respectively, which facilitate the removal of the flow control valves from supporting first and second wall members 34 and 38, respectively.

Alternative embodiments for the flow control valves 40 and 42 are shown in FIGS. 3 through 12. Liquid outlet flow control valve 42 comprises an elastomeric first domed portion 48 containing a first slit 49 for allowing the passage of a selected fluid out of drinking cup 10 through first domed portion 48. Similarly, air inlet flow control valve 40 comprises an elastomeric second domed portion 50 containing a second slit 51 for allowing the passage of air into drinking cup 10 through second domed portion 50 while liquid passes out of drinking cup 10. Each of first and second domed portions 48 and 50 is surrounded by a perimetral portion 52 which connects flow control valves 40 and 42 to first and second wall members 34 and 38, respectively. By appropriately selecting the interior dimensions of perimetral portions 52, each of flow control valves 40 and 42 may be disposed to surround a portion of first and second wall members 34 and 38, respectively.

Figure 3:
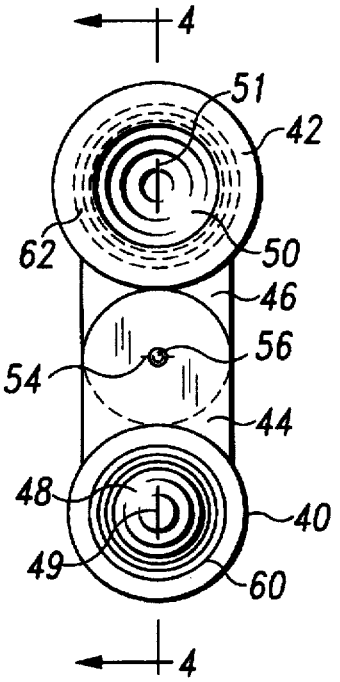
FIG. 3 is an enlarged plan view of a first preferred embodiment of the flow control valves joined by a co-engagement of the handle portions.
Figure 4:
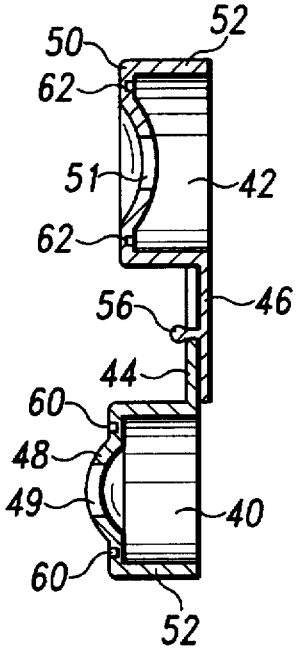
FIG. 4 is a sectional view of the structure shown in FIG. 3 taken along line 4—4.

As shown in FIGS. 3 and 4, first and second handle portions 44 and 46 are unitarily joined to an edge of the perimetral portion 52. First and second handle portions 44 and 46 can be dimensioned to overlap as shown in FIGS. 3 and 4 and to include joining means for joining first and second handle portions 44 and 46 together. The joining means shown in FIGS. 3 and 4 comprises an aperture 54 in second handle portion 46 and a protuberance 56 in first handle portion 44 which can project through the aperture 54.

Figure 5:
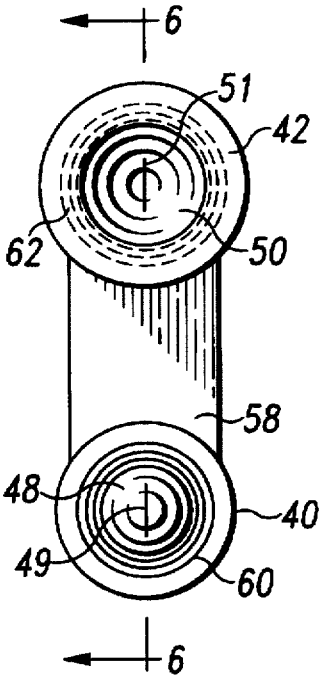
FIG. 5 is an enlarged plan view of a second preferred embodiment of the flow control valves joined by an integral continuous bridge.
Figure 6:
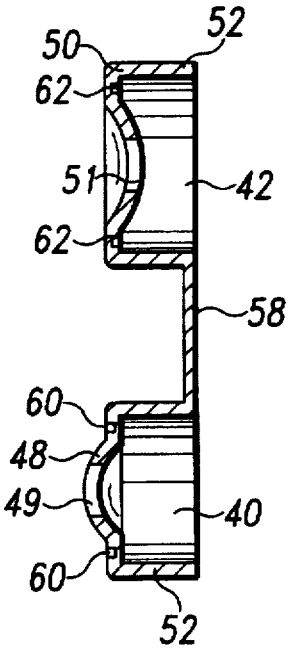
FIG. 6 is a sectional view of the structure shown in FIG. 5 taken along line 6—6.

In the alternative embodiment shown in FIGS. 5 and 6, the coupling means can take the form of a continuous bridge 58 joining together upper edges of perimetral portions 52 of flow control valves 40 and 42.

Figure 7:
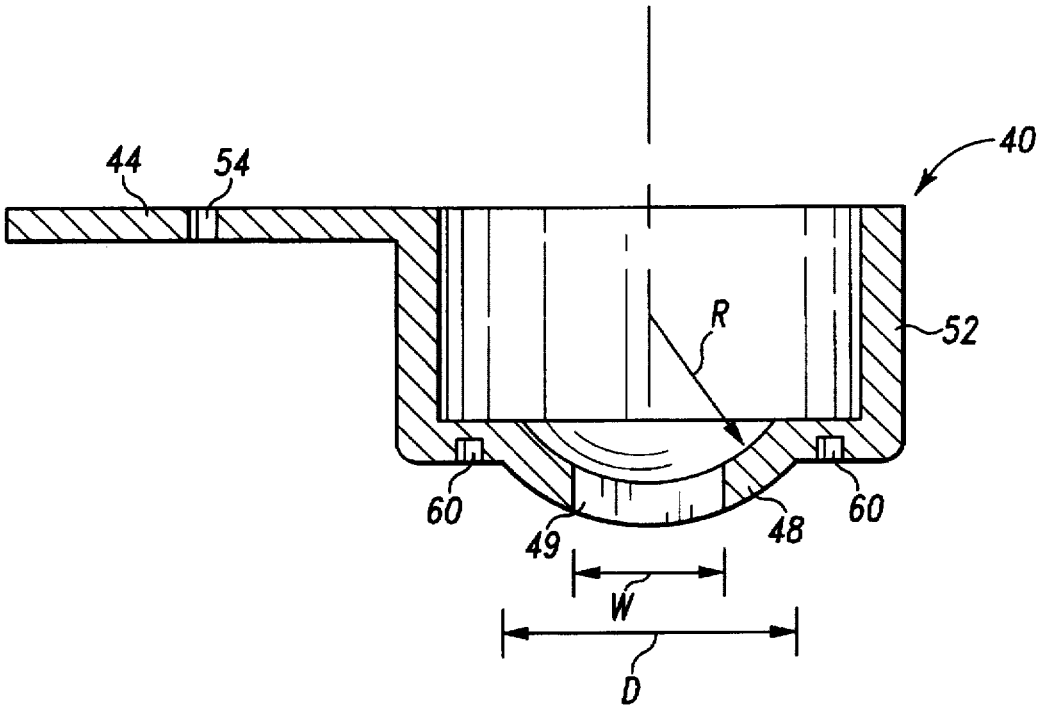
FIG. 7 is an enlarged sectional view similar to FIGS. 4 and 6 of the air inlet flow control valve of the present invention.

As shown in more detail in FIG. 7, first domed portion 48 of air inlet flow control valve 40 is surrounded by a generally circular first isolating channel 60 which enhances the ability of first domed portion 48 to flex in response to changes in pressure. First isolating channel 60 may be disposed to project generally oppositely from first wall member 34, that is, facing away from first wall member 34 which supports the air inlet flow control valve 40 with respect to interior surface 36 of cover 14. It will be understood that first isolating channel 60 may alternatively be disposed in confronting relationship to first wall member 34. First isolating channel 60 has a diameter "D" which is shown to be less than twice the defining radius "R" of first domed portion 48 of air inlet flow control valve 40 so that first domed portion 48 comprises less than a hemisphere. The width "W" of first slit 49 controlling the inward flow of air into drinking cup 10 through air inlet flow control valve 40 is about 60% to about 85% of the defining radius "R" of first domed portion 48 and is about 35% to about 40% of the diameter "D" of first isolating channel 60.

Figure 8:
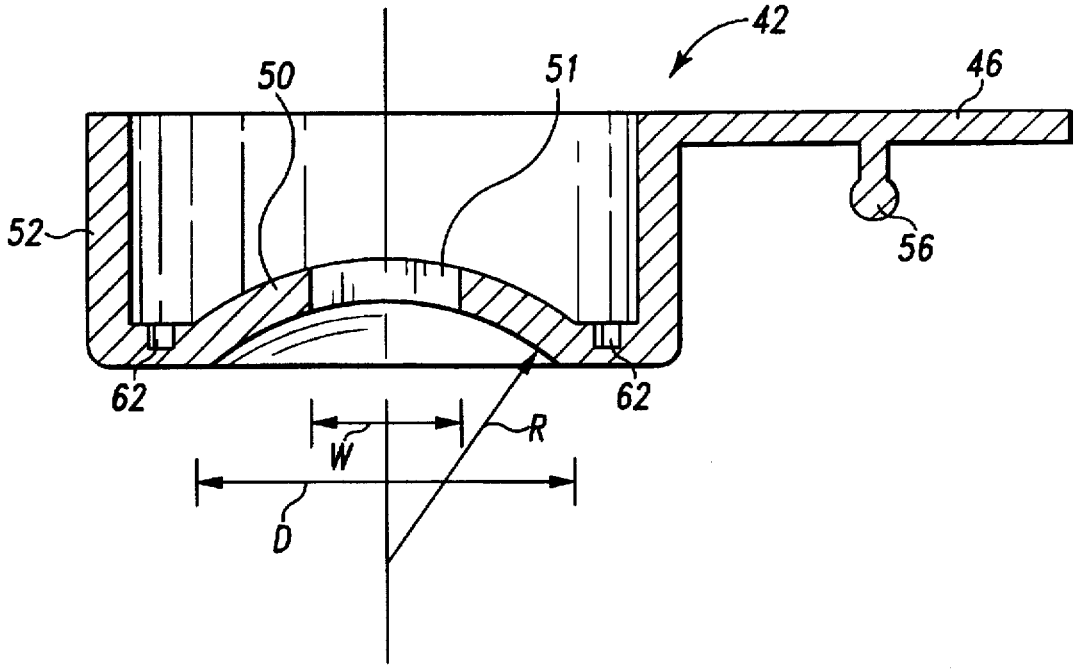
FIG. 8 is an enlarged sectional view similar to FIGS. 4 and 6 of the liquid outlet flow control valve of the present invention.

Referring to FIG. 8, second domed portion 50 of liquid outlet flow control valve 42 is surrounded by a generally circular second isolating channel 62 which enhances the ability of second domed portion 50 to flex in response to changes in pressure. Second isolating channel 62 may be disposed to confront second wall member 38 which supports the liquid outlet flow control valve 42 with respect to interior surface 36 of cover 14. Alternatively, second isolating channel 62 may be disposed to project generally oppositely from second wall member 38, that is, facing away from second wall member 38 which supports the liquid outlet flow control valve 42 with respect to interior surface 36 of cover 14. The second isolating channel 62 has a diameter "D" which is shown to be less than twice the defining radius "R" of second domed portion 50 of liquid outlet flow control valve 42 so that second domed portion 50 comprises less than a hemisphere. The width "W" of second slit 51 controlling the outward flow of the liquid through liquid outlet flow control valve 42 is about 50% to about 70% of the defining radius "R" of second domed portion 50 and is about 60% of the diameter "D" of second isolating channel 62.

It will be additionally noted that in each of the illustrated embodiments, the overall size of liquid outlet flow control valve 42 is larger than air inlet flow control valve 40. In the illustrated preferred embodiments, the air inlet flow control valve 40 is between about 60% to about 85% of the size of liquid outlet flow control valve 42.

Figure 9:
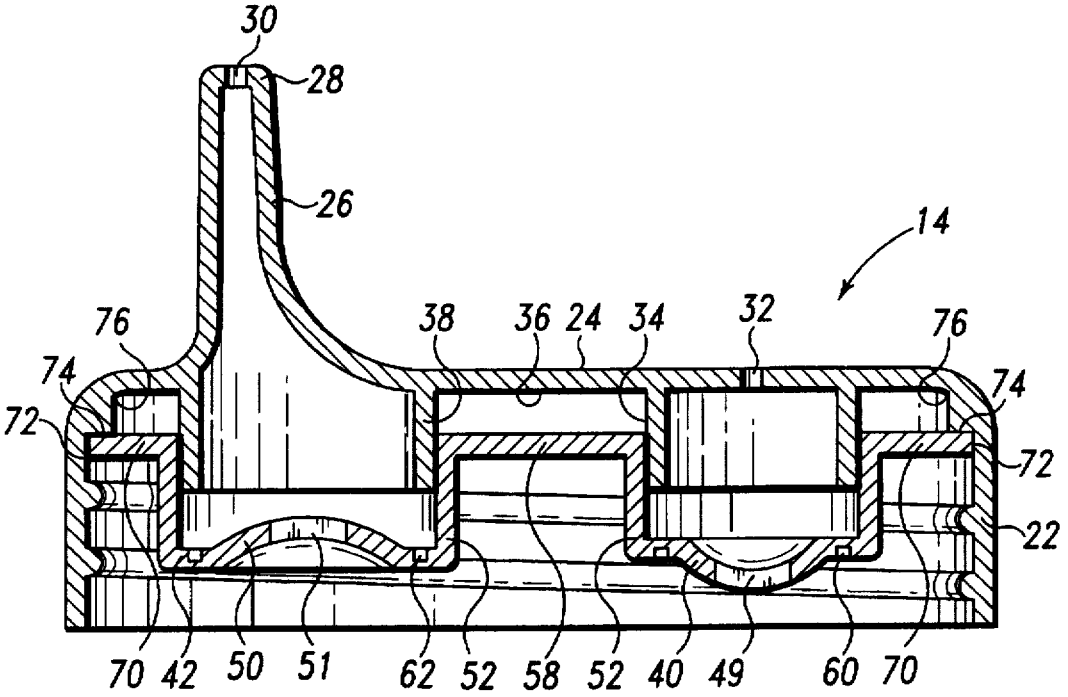
FIG. 9 is a sectional view of a third preferred embodiment in accordance with the present invention depicting a cover for a drinking cup and a continuous bridge having a diaphragm.

In an embodiment of the invention illustrated in FIG. 9, continuous bridge 58 joining the upper edges of perimetral portions 52 of flow control valves 40 and 42 is in the form of a diaphragm 70 having an outer edge 72 positioned adjacent to an interior edge 74 of cover 14 so as to provide a seal between body portion 12 and the cover 14. The diaphragm 70 also isolates interior surface 36 of cover 14 from the contents of drinking cup 10, thereby reducing the possibility of residual food contamination from retained material in interior corners 76 of the cover 14.

Figure 10:
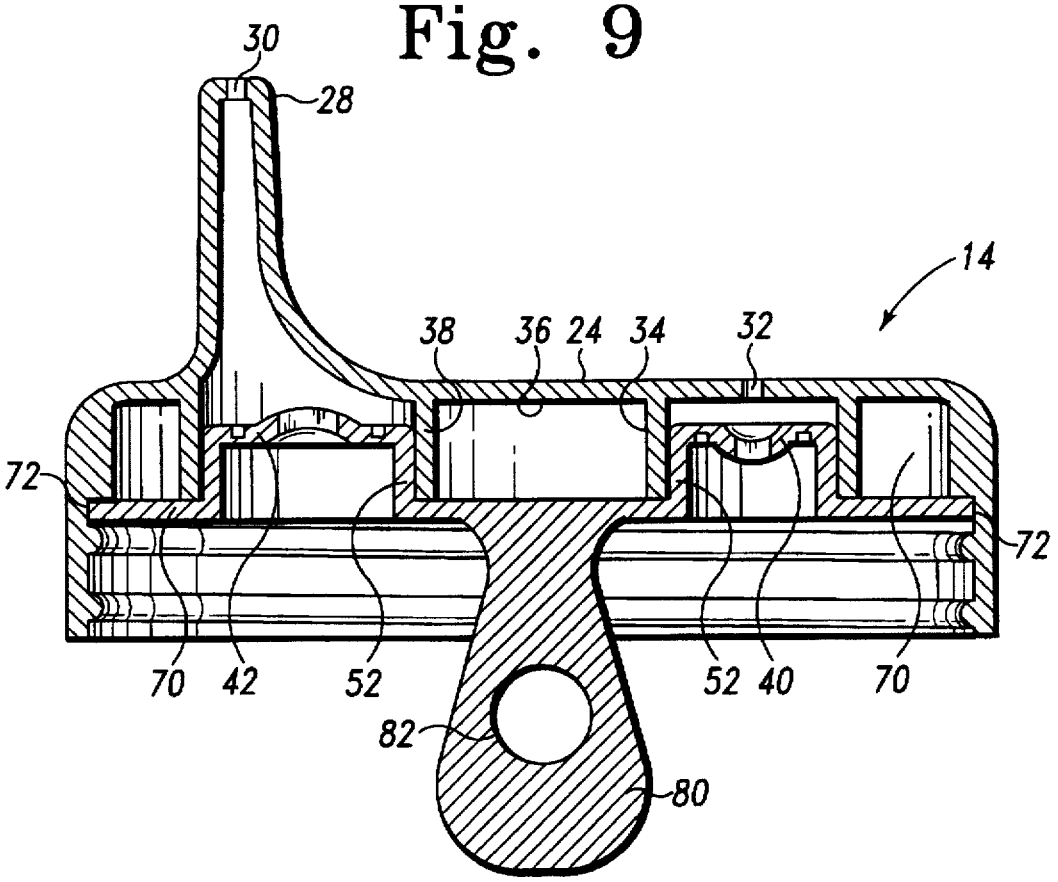
FIG. 10 is a sectional view of a fourth preferred embodiment in accordance with the present invention depicting a cover for a drinking cup and a continuous bridge having a diaphragm and a graspable tab.

Depicted in FIG. 10 is a fourth embodiment of the present invention, depicting cover 14 having coupling means including diaphragm 70 mounted to air inlet flow control valve 40 and liquid outlet flow control valve 42. Diaphragm 70 defines outer edge 72 capable of providing a seal between body portion 12 and cover 14, when cover 14 is attached to body portion 12. Graspable, elongated tab 80, defining tab hole 82, is attached to diaphragm 70 so at to project generally away from interior surface 36 of cover 14, facilitating removal of air inlet flow control valve 40 from first wall member 34 and liquid outlet flow control valve 42 from second wall member 38. By appropriately selecting the interior dimensions of perimetral portions 52, each of flow control valves 40 and 42 may be disposed to fit within a portion of first and second wall members 34 and 38, respectively.

Figure 11:
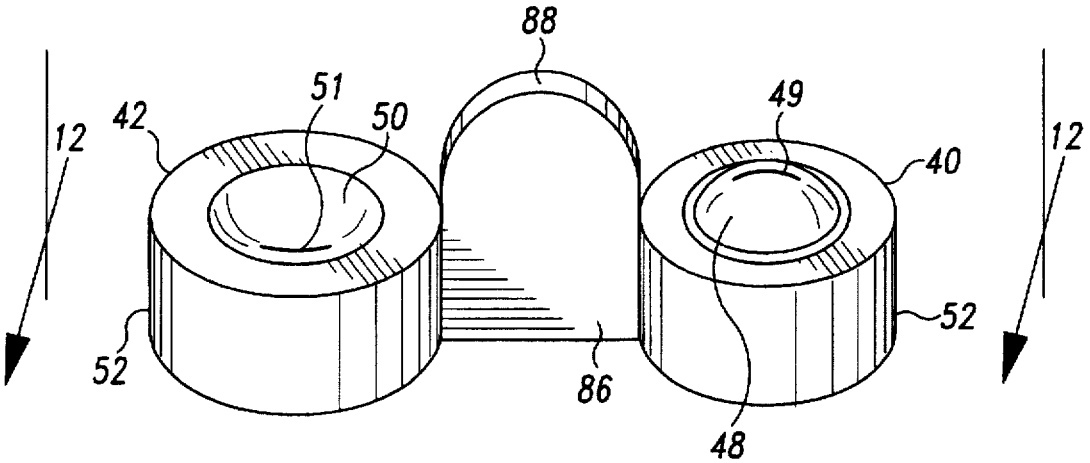
FIG. 11 is a perspective view of another embodiment of the flow control valves of the present invention depicted as joined together with an attachment member.
Figure 12:
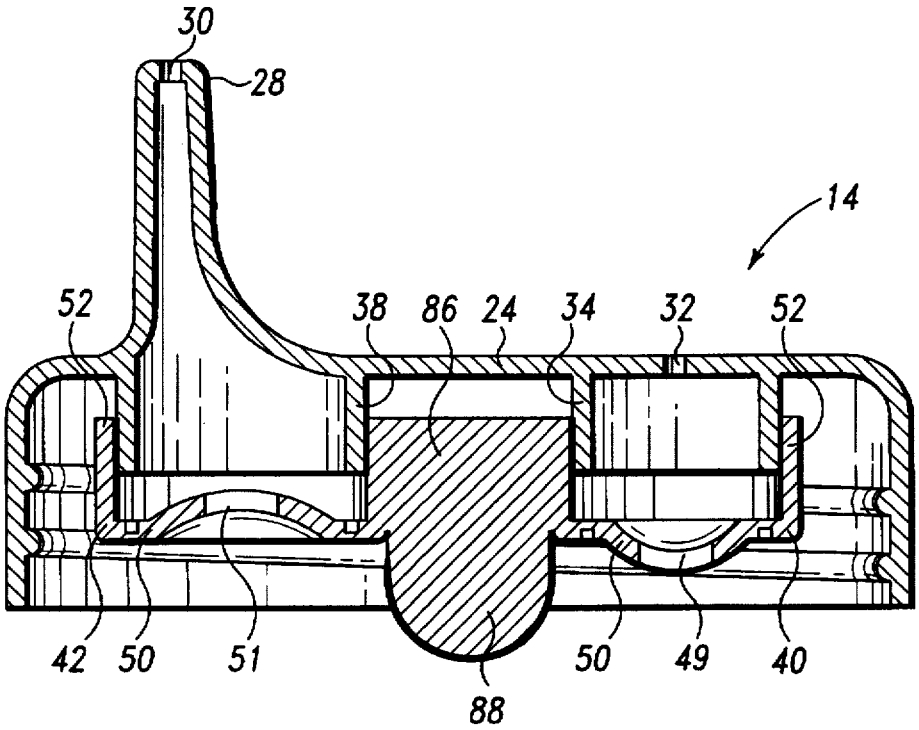
FIG. 12 is a sectional view of the structure shown in FIG. 11 taken along line 12—12 but depicted as mounted to the cover.

Illustrated in FIGS. 11–12 is another embodiment of the present invention, illustrating the flow control valves as joined together with generally planar attachment member 86 having graspable projecting portion 88. Although, as depicted in FIG. 12, projecting portion 88 forms a generally arched configuration as seen in cross section, it will be recognized that projecting portion 88 may have other configurations so that the cross-sectional profile presented by projecting portion 88 may include, for example, arches of various heights and profiles utilizing at least one curve, along with profiles utilizing at least one straight line. The dimensions of attachment member 86 and especially the planar dimensions of projecting portion 88 may be chosen to be sufficiently large so that when the flow control valves are joined together with attachment member 86, the resulting structure is too large to be easily swallowed. Attachment member 86 is attached between air inlet flow control valve 40 and liquid outlet flow control valve 42 so that a plane defined by attachment member 86 is disposed to be generally normal to interior surface 36 of top wall 24, and so that projecting portion 88 projects generally away from interior surface 36, that is, generally towards body portion 12 when cover 14 is mounted to body portion 12. In this way, provision of attachment member 86 facilitates essentially simultaneous removal of air inlet flow control valve 40 from first wall member 34 and liquid outlet flow control valve 42 from second wall member 38 by grasping projecting portion 88 and pulling attachment member 86 away from cover 14. Moreover, by choosing dimensions of attachment member 86 so that projecting portion 88 is disposed to project a substantial distance from the flow control valves, easy grasping of attachment member 86 for removal of the flow control valves is accomplished.

The present invention having been described in its preferred embodiments, it is clear that the present invention is susceptible to numerous modifications and embodiments within the ability of those skilled in the art and without the exercise of the inventive faculty. Accordingly, the scope of the present invention is defined as set forth by the scope of the following claims.

What is claimed is:

1. A cap for a drinking cup having a body portion capable of holding a fluid, comprising:

a cover capable of removable attachment to the body portion and including a top wall defining at least one hole and a vent aperture disposed through the cover, the at least one hole disposed separate from the vent aperture so that when the cover is attached to the body portion, air may enter the body portion through the vent aperture as liquid exits the body portion through the at least one hole;

a first wall member disposed surrounding the vent aperture and mounted to and projecting generally away from an interior surface of the top wall;

a second wall member disposed surrounding the at least one hole and mounted to and projecting generally away from the interior surface;

an air inlet flow control valve mounted to the first wall member, capable of fluid connection with the vent aperture and including an elastomeric first domed portion defining a normally closed first slit therethrough, so that when the cover is attached to the body portion, the first domed portion is capable of movement whereby the first slit opens generally towards the body portion upon occurrence of a pressure differential across the air inlet flow control valve with relatively lower pressure within the drinking cup, and remains closed in the absence of a pressure differential across the air inlet flow control valve and upon occurrence of a pressure differential across the air inlet flow control valve with relatively higher pressure within the drinking cup; and a liquid outlet flow control valve mounted to the second wall member, capable of fluid connection with the at least one hole and including an elastomeric second domed portion defining a second slit therethrough, so that when the cover is attached to the body portion, the second domed portion is capable of movement whereby the second slit opens generally away from the body portion upon occurrence of a pressure differential across the liquid outlet flow control valve with relatively higher pressure within the covered drinking cup, and remains closed in the absence of a pressure differential across the liquid outlet flow control valve and upon occurrence of a pressure differential across the liquid outlet flow control valve with relatively lower pressure within the covered drinking cup.

2. A cap for a drinking cup as defined in claim 1, wherein the top wall includes a spout disposed generally opposing the interior surface and having a distal end defining the at least one hole.

3. A cap for a drinking cup as defined in claim 1, further comprising coupling means for coupling the air inlet flow control valve to the liquid outlet flow control valve.

4. A cap for a drinking cup as defined in claim 3, wherein the coupling means includes a generally planar attachment member having a graspable projecting portion, the attachment member attached between the air inlet flow control valve and the liquid outlet flow control valve so that a plane defined by the attachment member is generally normal to the interior surface of the top wall and the projecting portion projects generally away from the interior surface and facilitates removal of the air inlet flow control valve from the first wall member and the liquid outlet flow control valve from the second wall member.

5. A cap for a drinking cup as defined in claim 3, wherein the coupling means includes a diaphragm mounted to the air inlet flow control valve and the liquid outlet flow control valve and defining an outer edge capable of providing a seal between the body portion and the cover when the cover is attached to the body portion.

6. A cap for a drinking cup as defined in claim 3, wherein the coupling means includes:

a diaphragm mounted to the air inlet flow control valve and the liquid outlet flow control valve and defining an outer edge capable of providing a seal between the body portion and the cover when the cover is attached to the body portion; and a graspable tab attached to the diaphragm to project generally away from the interior surface, facilitating removal of the air inlet flow control valve from the first wall member and the liquid outlet flow control valve from the second wall member.

7. A cap for a drinking cup as defined in claim 3 wherein the coupling means includes a first handle portion mounted to the air inlet flow control valve to facilitate the removal of the air inlet flow control valve from the first wall member, and a second handle portion mounted to the liquid outlet flow control valve to facilitate the removal of the liquid outlet flow control valve from the second wall member.

8. A cap for a drinking cup as defined in claim 7, wherein the coupling means includes a joining means for joining the first handle portion to the second handle portion.

9. A cap for a drinking cup as defined in claim 1 wherein:

the air inlet flow control valve further defines a first isolating channel disposed at least partially surrounding the first domed portion for enhancing elastomeric movement of the first domed portion upon occurrence of a pressure differential across the air inlet flow control valve with relatively lower pressure proximate to the interior surface of the top wall; and the liquid outlet flow control valve further defines a second isolating channel disposed at least partially surrounding the second domed portion for enhancing elastomeric movement of the second domed portion upon occurrence of a pressure differential across the liquid outlet flow control valve with relatively higher pressure proximate to the interior surface of the top wall.

10. A cap for a drinking cup as defined in claim 9, wherein the first and second isolating channels are generally circular and a diameter defined by the first isolating channel is less than a diameter defined by the second isolating channel.

11. A cap for a drinking cup as defined in claim 9, wherein:

the first and second isolating channels are generally circular;

a diameter defined by the first isolating channel is less than twice a radius defined by the first domed portion, whereby the first domed portion forms a portion of a hemisphere; and a diameter defined by the second isolating channel is less than twice a radius defined by the second domed portion, whereby the second domed portion forms a portion of a hemisphere.

12. A cap for a drinking cup as defined in claim 11, wherein the first isolating channel is disposed to project generally oppositely from the first wall and the second isolating channel is disposed generally confronting the second wall.

13. A cap for a drinking cup having a body portion capable of holding a fluid, comprising:

a cover capable of removable attachment to the body portion and including a top wall defining at least one hole and a vent aperture disposed through the cover, the at least one hole disposed separate from the vent aperture so that when the cover is attached to the body portion, air may enter the body portion through the vent aperture as liquid exits the body portion through the at least one hole;

a first wall member disposed surrounding the vent aperture and mounted to and projecting generally away from an interior surface of the top wall;

a second wall member disposed surrounding the at least one hole and mounted to and projecting generally away from the interior surface;

an air inlet flow control valve mounted to the first wall member, capable of fluid connection with the vent aperture and including an elastomeric first domed portion defining a normally closed first slit therethrough and defining a generally circular first isolating channel disposed at least partially surrounding the first domed portion, so that when the cover is attached to the body portion, the first domed portion is capable of movement whereby the first slit opens generally towards the body portion upon occurrence of a pressure differential across the air inlet flow control valve with relatively lower pressure within the drinking cup, and remains closed in the absence of a pressure differential across the air inlet flow control valve and upon occurrence of a pressure differential across the air inlet flow control valve with relatively higher pressure within the drinking cup;

a liquid outlet flow control valve mounted to the second wall member, capable of fluid connection with the at least one hole and including an elastomeric second domed portion defining a second slit therethrough and defining a generally circular second isolating channel disposed at least partially surrounding the second domed portion, so that when the cover is attached to the body portion, the second domed portion is capable of movement whereby the second slit opens generally away from the body portion upon occurrence of a pressure differential across the liquid outlet flow control valve with relatively higher pressure within the covered drinking cup, and remains closed in the absence of a pressure differential across the liquid outlet flow control valve and upon occurrence of a pressure differential across the liquid outlet flow control valve with relatively lower pressure within the covered drinking cup; and coupling means for coupling together the air inlet flow control valve and the liquid outlet flow control valve.

14. A cap for a drinking cup as defined in claim 13, wherein:

the coupling means includes a generally planar attachment member having a graspable projecting portion, the attachment member attached between the air inlet flow control valve and the liquid outlet flow control valve so that a plane defined by the attachment member is generally normal to the interior surface of the top wall and the projecting portion projects generally away from the interior surface and facilitates removal of the air inlet flow control valve from the first wall member and the liquid outlet flow control valve from the second wall member;

a diameter defined by the first isolating channel is less than twice a radius defined by the first domed portion, whereby the first domed portion forms a portion of a hemisphere; and a diameter defined by the second isolating channel is less than twice a radius defined by the second domed portion, whereby the second domed portion forms a portion of a hemisphere.

15. A covered drinking cup comprising:

a body portion capable of holding a fluid;

a cover removably attached to the body portion and including a top wall defining at least one hole and a vent aperture disposed through the cover, the at least one hole disposed separate from the vent aperture whereby air may enter the body portion through the vent aperture as liquid exits the body portion through the at least one hole;

a first wall member disposed surrounding the vent aperture and mounted to and projecting generally away from an interior surface of the top wall;

a second wall member disposed surrounding the at least one hole and mounted to and projecting generally away from the interior surface;

an air inlet flow control valve mounted to the first wall member, capable of fluid connection with the vent aperture and including an elastomeric first domed portion defining a normally closed first slit therethrough and capable of movement whereby the first slit opens generally towards the body portion upon occurrence of a pressure differential across the air inlet flow control valve with relatively lower pressure within the covered drinking cup, and remains closed in the absence of a pressure differential across the air inlet flow control valve and upon occurrence of a pressure differential across the air inlet flow control valve with relatively higher pressure within the covered drinking cup; and a liquid outlet flow control valve mounted to the second wall member, capable of fluid connection with the at least one hole and including an elastomeric second domed portion defining a second slit therethrough and capable of movement whereby the second slit opens generally away from the body portion upon occurrence of a pressure differential across the liquid outlet flow control valve with relatively higher pressure within the covered drinking cup, and remains closed in the absence of a pressure differential across the liquid outlet flow control valve and upon occurrence of a pressure differential across the liquid outlet flow control valve with relatively lower pressure within the covered drinking cup.

16. A covered drinking cup as defined in claim 15, wherein the top wall includes a spout disposed to project generally away from the body portion and having a distal end defining the at least one hole.

17. A covered drinking cup as defined in claim 15, further comprising releasable locking engagement means for releasably and lockably engaging the cover with the body portion.

18. A covered drinking cup as defined in claim 15, further comprising coupling means for coupling the air inlet flow control valve to the liquid outlet flow control valve.

19. A covered drinking cup as defined in claim 18, wherein the coupling means includes a diaphragm mounted to the air inlet flow control valve and the liquid outlet flow control valve and defining an outer edge capable of being positioned between an edge defined by the body portion and a lower inner edge defined by the cover to provide a seal between the body portion and the cover.

20. A covered drinking cup as defined in claim 18, wherein the coupling means includes a generally planar attachment member having a graspable projecting portion, the attachment member attached between the air inlet flow control valve and the liquid outlet flow control valve so that a plane defined by the attachment member is generally normal to the interior surface of the top wall and the projecting portion projects generally away from the interior surface and facilitates removal of the air inlet flow control valve from the first wall member and the removal of the liquid outlet flow control valve from the second wall member.

21. A covered drinking cup as defined in claim 18, wherein the coupling means includes:

a diaphragm mounted to the air inlet flow control valve and the liquid outlet flow control valve and defining an outer edge capable of providing a seal between the body portion and the cover; and a graspable tab attached to the diaphragm to project generally away from the interior surface, facilitating removal of the air inlet flow control valve from the first wall member and the liquid outlet flow control valve from the second wall member.

22. A covered drinking cup as defined in claim 18 wherein the coupling means includes a first handle portion mounted to the air inlet flow control valve to facilitate the removal of the air inlet flow control valve from the first wall member, and a second handle portion mounted to the liquid outlet flow control valve to facilitate the removal of the liquid outlet flow control valve from the second wall member.

23. A covered drinking cup as defined in claim 22, wherein the coupling means includes a joining means for joining the first handle portion to the second handle portion.

24. A covered drinking cup as defined in claim 15, wherein:

the air inlet flow control valve further defines a first isolating channel disposed at least partially surrounding the first domed portion for enhancing elastomeric movement of the first domed portion upon occurrence of a pressure differential across the air inlet flow control valve with relatively lower pressure within the covered drinking cup; and the liquid outlet flow control valve further defines a second isolating channel disposed at least partially surrounding the second domed portion for enhancing elastomeric movement of the second domed portion upon occurrence of a pressure differential across the liquid outlet flow control valve with relatively higher pressure within the covered drinking cup.

25. A covered drinking cup as defined in claim 24, wherein the first and second isolating channels are generally circular and a diameter defined by the first isolating channel is less than a diameter defined by the first isolating channel.

26. A covered drinking cup as defined in claim 24, wherein:

the first and second isolating channels are generally circular;

a diameter defined by the first isolating channel is less than twice a radius defined by the first domed portion, whereby the first domed portion forms a portion of a hemisphere; and a diameter defined by the second isolating channel is less than twice a radius defined by the second domed portion, whereby the second domed portion forms a portion of a hemisphere.

27. A covered drinking cup as defined in claim 26, wherein the first isolating channel is disposed to project generally oppositely from the first wall and the second isolating channel is disposed generally confronting the second wall.

28. A covered drinking cup as defined in claim 26, wherein the body portion includes a relatively broad base and a concave sidewall defining a relatively narrow waist portion.

29. Flow control means for use with a cover capable of removable attachment to a body portion of a drinking cup, the cover including a top wall defining at least one hole and a vent aperture disposed through the cover, the at least one hole disposed separate from the vent aperture so that when the cover is attached to the body portion, air may enter the body portion through the vent aperture as liquid exits the body portion through the at least one hole, the flow control means comprising:

an air inlet flow control valve including an elastomeric first domed portion having a normally closed first slit therethrough, and means for coupling the air inlet flow control valve to the cover adjacent to the vent aperture;

a liquid outlet flow control valve including an elastomeric second domed portion defining a second slit therethrough, and means for coupling the liquid outlet flow control valve to the cover adjacent to the at least one hole; and a generally planar attachment member attached between the air inlet flow control valve and the liquid outlet flow control valve.

30. The flow control means of claim 29 wherein the generally planar attachment member comprises a graspable projecting portion, the attachment member lying substantially in a plane defined by the attachment member which is generally normal to the interior surface of the top wall and the projecting portion projects generally away from the interior surface and facilitates uncoupling of the air inlet flow control valve and the liquid outlet flow control valve from the cover.

31. The flow control means of claim 29 wherein the generally planar attachment member comprises a diaphragm having an outer edge capable of providing a seal between the body portion and the cover when the cover is attached to the body portion.

32. The flow control means of claim 29 wherein the generally planar attachment member comprises a graspable tab projecting generally away from the top wall interior surface, facilitating decoupling of the air inlet flow control valve and the liquid outlet flow control valve from the cover.

33. The flow control means of claim 29 wherein:

the air inlet flow control valve further defines a first isolating channel disposed at least partially surrounding the first domed portion for enhancing elastomeric movement of the first domed portion upon occurrence of a pressure differential across the air inlet flow control valve with relatively lower pressure proximate to the interior surface of the top wall; and the liquid outlet flow control valve further defines a second isolating channel disposed at least partially surrounding the second domed portion for enhancing elastomeric movement of the second domed portion upon occurrence of a pressure differential across the liquid outlet flow control valve with relatively higher pressure proximate to the interior surface of the top wall.

34. The flow control means of claim 33, wherein the first and second isolating channels are generally circular and a diameter defined by the first isolating channel is less than a diameter defined by the second isolating channel.

35. The flow control means of claim 33, wherein:

the first and second isolating channels are generally circular;

a diameter defined by the first isolating channel is less than twice a radius defined by the first domed portion, whereby the first domed portion forms a portion of a hemisphere; and a diameter defined by the second isolating channel is less than twice a radius defined by the second domed portion, whereby the second domed portion forms a portion of a hemisphere.

36. The flow control means of claim 33, wherein the first isolating channel is disposed to project generally oppositely from the top wall interior surface and the second isolating channel is disposed generally confronting the top wall interior surface.

* * * * *